US005371998A

United States Patent [19]

Johnson et al.

[11] Patent Number: 5,371,998

[45] Date of Patent: Dec. 13, 1994

[54] MODIFIED ATMOSPHERE PACKAGING DEVICE

[75] Inventors: Randall E. Johnson, Campobello; Stephen L. Gray, Moore, both of S.C.

[73] Assignee: W. R. Grace & Co.-Conn., Duncan, S.C.

[21] Appl. No.: 3,709

[22] Filed: Jan. 13, 1993

[51] Int. Cl.[5] ..... B65B 31/02

[52] U.S. Cl. ..... 53/432; 53/90; 53/478; 53/510

[58] Field of Search ..... 53/433, 432, 434, 510, 53/511, 512, 478, 90

[56] References Cited

U.S. PATENT DOCUMENTS 3,436,894 4/1969 Sorensen ..... 53/478
4,058,953 11/1977 Sanborn, Jr. et al. ..... 53/433
4,152,464 5/1979 Brody et al. ..... 53/478 X
4,294,859 10/1981 Lundquist et al. ..... 53/434 X
4,409,252 10/1983 Buschkens et al. ..... 53/432 X
4,791,775 12/1988 Raque et al. ..... 53/510

FOREIGN PATENT DOCUMENTS 340771 9/1921 Germany ..... 53/90

*Primary Examiner*—James F. Coan
*Attorney, Agent, or Firm*—William D. Lee, Jr.; Mark B. Quatt; George Legg

[57] ABSTRACT

Devices for packaging selected items. More particularly, the present invention relates to devices for continuously packaging selected items in a controlled atmosphere enclosure. Further, the present invention relates to devices for continuously sealing containers containing selected items in a controlled atmosphere.

7 Claims, 2 Drawing Sheets

MODIFIED ATMOSPHERE PACKAGING DEVICE

BACKGROUND OF THE INVENTION

1. Field of the Invention

The present invention relates to devices for packaging selected items. More particularly, the present invention relates to devices for continuously packaging selected items in a controlled atmosphere enclosure. Further, the present invention relates particularly to devices for continuously packaging selected food items in a controlled atmosphere enclosure.

2. Description of the Related Art

It is known to package items, for example selected food items, in packages having a controlled atmosphere. Normally, this controlled atmosphere is a low oxygen atmosphere, with the oxygen replaced by an inert gas. Such controlled atmosphere enclosures or packages are necessary to insure adequate shelf life for many of the selected food items, for example. By eliminating the majority of oxygen from the package, the shelf life of the food item is greatly increased. Controlled atmosphere enclosures or packages are necessary for other items such as, for example, electronic components and moisture and oxygen sensitive materials. In certain applications this controlled atmosphere is preferably a high oxygen content atmosphere.

Normally, the controlled atmosphere within the package is obtained in one of two conventional ways. First, machines have been adapted to simply introduce the inert gas into the stationary package, with the inert gas partially displacing the ambient oxygen in the package. After the inert gas is introduced, the package is sealed. A teaching of this type may be found in U.S. Pat. No. 4,409,252 issued to Buschkens et al. for example. This method has generally proved unsatisfactory because it is extremely difficult to lower the oxygen content within the package to a desirable level, and it is extremely slow.

The second method of achieving a controlled atmosphere in the package has been by utilizing a vacuum in combination with a gas flush machine. In such a conventional machine, the package is placed in a vacuum chamber which creates a vacuum in the package. After the vacuum has been created in the package, the selected gas is introduced into the package, and the package is then sealed. Examples of teaching of this type include, for example. U.S. Pat. No. 4,009,552 issued to Schlachter, and U.S. Pat. No. 4,294,859 issued to Lundquist et al. However, all of these conventional vacuum gas flush devices utilize a vacuum chamber to perform these functions. In all of these devices, it is necessary for the package to stop for a period of time in the vacuum chamber. Thus, none of the conventional vacuum gas flush devices is capable of continually conveying a series of packages, with the controlled atmosphere introduced into the package and the package sealed without stopping the packages. Production using conventional devices is slow an therefore expensive. Some conventional vacuum gas flush devices, such as that disclosed in U.S. Pat. No. 4,058,953 issued to Sanborn, Jr. et al. and U.S. Pat. No. 4,791,775 issued to Raque et al., for example, also introduce a vacuum through one side of the package, while the selected gas in introduced through the opposite side of the package. However, these systems require a flexible container into which slits can be cut and then resealed after evacuation and modified atmosphere introduction.

OBJECTS AND SUMMARY OF THE INVENTION

One object of the present invention is to provide a controlled atmosphere packaging device that is capable of creating a controlled atmosphere within a package, and is also capable of sealing the package to maintain that selected controlled atmosphere.

Another object of the present invention is to provide a controlled atmosphere packaging device that is capable of creating a controlled atmosphere within the package without the use of a vacuum chamber.

Yet another object of the present invention is to provide a controlled atmosphere packaging device that is capable of creating a controlled atmosphere within the package with the use of a vacuum chamber which allows the packaging operation to be a continuous operation.

Accordingly, one form of the present invention relates to an apparatus for packaging an item in a controlled atmosphere enclosure, the apparatus comprising a means for continuously transporting a series of open item bearing containers along a path, means for producing and maintaining a modified atmosphere chamber, means for sequentially introducing one open container at a time, as it moves along said path, into said modified atmosphere chamber, means for sealing the open container within the modified atmosphere chamber comprising a rotating drum heat sealing means, and means for sequentially removing one sealed container at a time, as it moves along said path, from said modified atmosphere chamber.

Another form of the present invention relates to a method of continuously preparing a plurality of modified atmosphere filled or flushed sealed item bearing containers, the improvement comprising, introducing each container into a modified atmosphere through an entrance means, sealing said container utilizing a thermoplastic film and a rotating heated drum sealing means, or other sealing method common to the art, and removing said container from said modified atmosphere through an exit means.

Preferred forms of the invention, as well as other embodiments, objects, features and advantages of this invention, will be apparent from the following detailed description which is to be read in connection with the accompanying drawings.

DESCRIPTION OF THE PREFERRED EMBODIMENTS OF THE INVENTION

Figure 1:
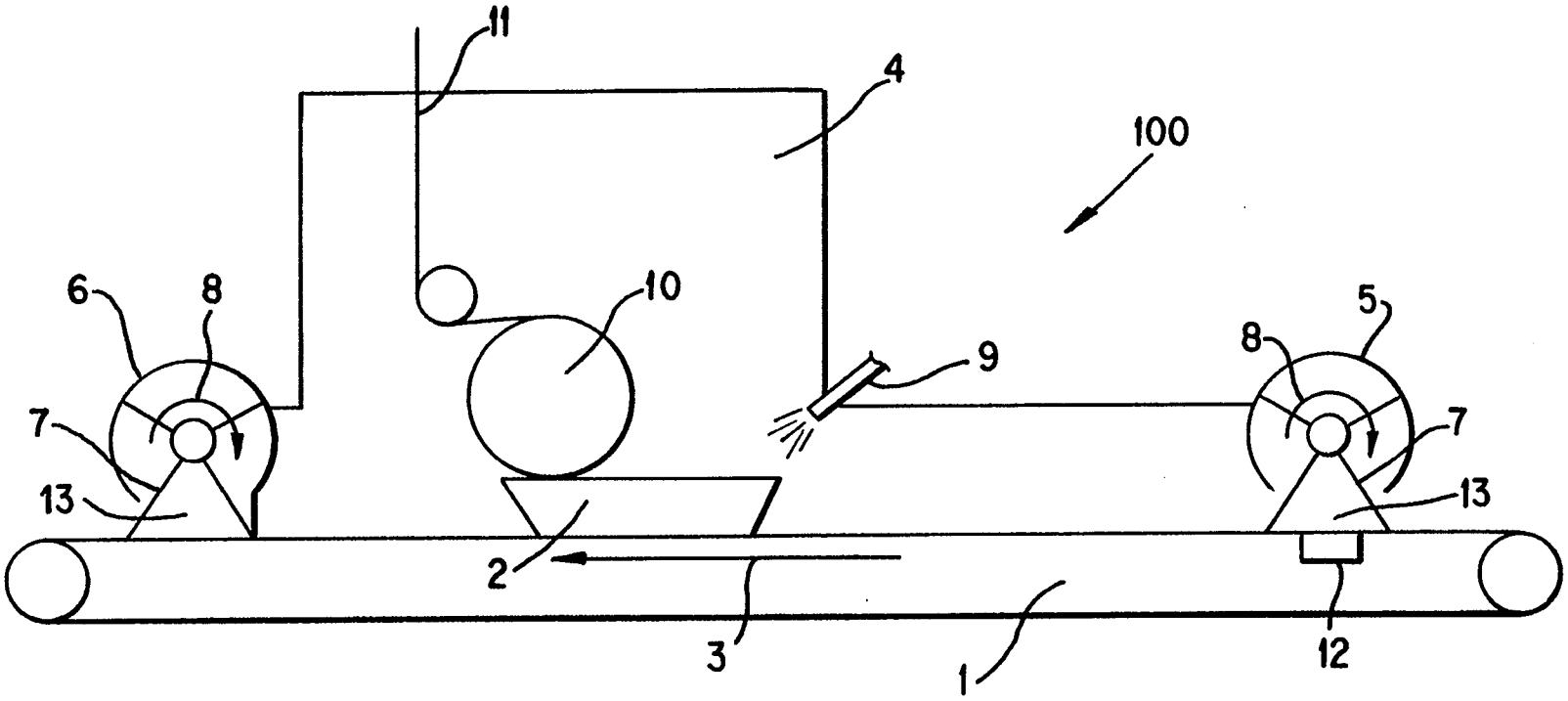
FIG. 1 is a schematic view of a preferred embodiment of the present invention.

The present invention will be better understood from the specification taken in conjunction with the accompanying drawings in which like reference numerals refer to like parts.

In FIG. 1 there is shown a preferred embodiment of the modified atmosphere packaging device 100 according to the present invention. The packaging device 100 includes a container transport means 1 configured to move the containers 2 in a continuous fashion in the direction of the arrow 3. Although the mechanism for moving the transport means 1 and containers 2 in this continuous fashion is not shown, it will be understood that such mechanisms are well know in this art. Each container 2 is fill with a selected item (not shown). It will be understood that the selected item has been positioned in each container 2 before the container 2 enters the illustrated packaging device 100 by associated machinery that is not shown. Again, this associated machinery for inserting the selected item into the containers 2 is well known in this art.

The packaging device 100 also comprises a housing 4 having an entrance means 5 and a exit means 6, both of said entrance means having retractable sealing vanes 7 therein. Said vanes 7 in both said means 5 and 6 rotating in the direction of arrows 8. The entrance and exit means may also be any conventional means that operate in a conventional manner to produce a gas tight sealed entrance and exit and the mechanisms associated with their operation are well known in the art. Housing 4 also includes a gas inlet means 9 for introducing the modified atmosphere and to maintain a positive pressure in the packaging device 100, if desired. Again, the associated machinery and connections associated with gas delivery means are well known in the art. Also included is a sealing means 10 over which passes film 11 which sealing means 10 presses and seals film 11 over container 2. The sealing means of the present invention is well known in the art as is the associated equipment and the films and conditions used to seal films to item containing containers and need not be further discussed here. Further, the conditions necessary to seal a particular film to a particular container may be determined by one skilled in this art without undue experimentation. If desired the modified atmosphere packaging device 100 may also incorporate a vacuum means 12 located such that a vacuum may be placed on the container and contained item while they are in the sealed container of entrance means 5, defined by the extended vanes **7*b* (see FIG. 2). Once again, the associated machinery for producing a vacuum evacuated area is well known by those skilled in the art. The presently preferred sealing means 10 is a heated roll sealing means. The presently preferred film 11** is a thermoplastic sealing film. Both of these are well known and understood in the art.

Figure 2:
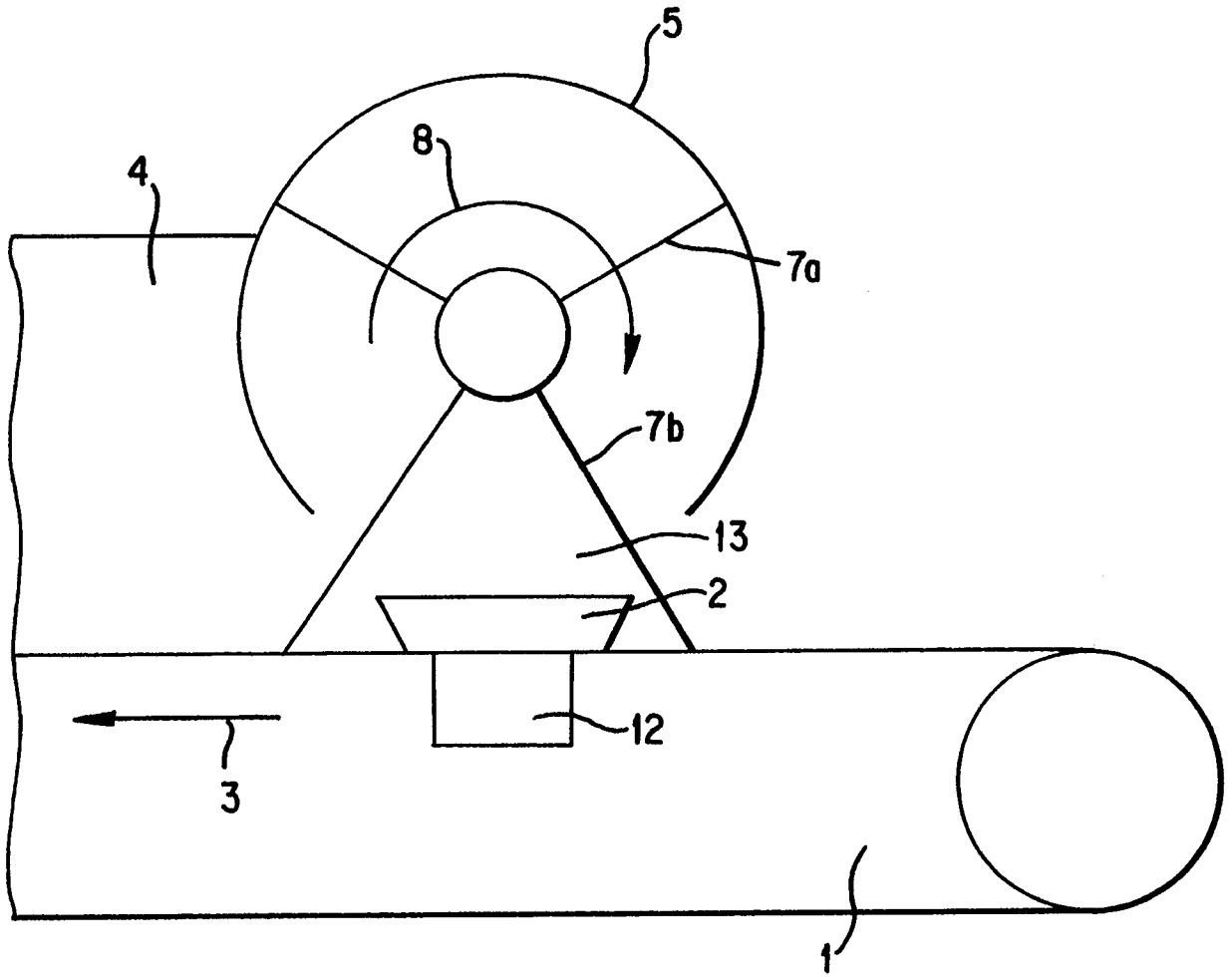
FIG. 2 is a schematic detailed view of a preferred embodiment of the entrance and exit closures.

FIG. 2 shows in greater detail the components of the preferred entrance and exit means 5 and 6. With particular attention to entrance means 5, there is shown a housing portion which houses entrance means 5 having retracted vanes **7*a* and extended vanes 7*b* rotating In the direction of the arrow 8. The extended vanes 7*b* have sealing means on their sides which seal to the walls of said housing of entrance means 5 and the ends of said vanes 7*b* seal to the upper surface of transport means 1, thereby producing a substantially gas tight sealed chamber area 13, which may be evacuated by vacuum means 12 if so desired. It is to be understood that the sealed chamber area 13 is sealed both from the outside atmosphere and from the modified atmosphere of the packaging device 100**. It is to be further understood that the sealed chamber area may be intermittently stopped, but is preferably continuously moving such that the packaging process is truly a continuos process.

The operation of the device of the subject invention will now be described with particular reference to FIGS. 1 and 2. A container 2 previously loaded with an item is moved into the entrance means 5 by container transport means 1. Simultaneously, a vane **7*b* forms a substantially gas tight partition between the outside atmosphere and the modified atmosphere within the packaging device 100 in front of a container 2 about to be introduced into the packaging device 100. As the container 2 moves into the packaging device 100, a second vane 7*b* comes down behind the container 2 and creates a substantially gas tight chamber 13 encompassed by the two vanes 7*b*, the transport means 1 top surface and the housing portion of entrance means 5. During the period when this substantially gas tight chamber 13 encloses container 2 a vacuum means 12 may be utilized to degas the container 2 and its contents. The leading vane 7*b* then retracts to its retracted state 7*a* and allows the container 2 to enter the modified atmosphere area as transport means 1 moves the container 2 in the direction of arrow 3. The modified atmosphere is initiated and maintained by at least one gas inlet means 9. Said inlet means 9, or at least one on a plurality of inlet means 9, directs the modified atmosphere gas into the open container 2 and its contents contemporaneously with the sealing means 10 sealing container 2 with film 11. Transport means 1 continues to move the now sealed container 2 in the direction of arrow 3 and into exit means 6 which operates similarly to entrance means 5 and passes the now sealed container 2 out of the modified atmosphere and through a substantially gas tight chamber area 13** into the ambient atmosphere. The now sealed containers are then moved to other well known equipment for film cutting to separate the sealed containers well known to those skilled in the art. The use of these entrance and exit means allows for continuos package sealing and, if desirable, for a positive pressure in the modified atmosphere area of the packaging device. Introduction of the film into the modified atmosphere packaging device, and equipment to do this, is by means and equipment well known to those skilled in the art.

Gases which may be utilized for the modified atmosphere are well known in the art, with nitrogen gas being a preferred modified atmosphere gas. The apparatus and procedure according to the present invention substantially eliminates the possibility that air from the environment could return into the headroom of the container 2 after introduction of the modified atmosphere gas. Furthermore, this advantageous modified atmosphere packaging can be performed as a continuos process without the need for intermittent stopping of the package sealing operation.

The containers useful in the present invention are preferably synthetic material containers and the sealing film Is preferably a flexible thermoplastic film sealed to the rims of the synthetic material containers. These synthetic material containers and film materials are well known in the art and may be ascertained by one skilled in the art without undue experimentation.

Although the illustrative embodiments of the present invention have been described herein with reference to the accompanying drawings it is to be understood that the invention is not limited to those precise embodiments, and that various other changes and modifications may be effected therein by one skilled in the art without departing from the scope or spirit of the invention.

What is claimed is:

1. An apparatus for packaging an item in a controlled atmosphere enclosure, the apparatus comprising:

a) means for continuously transporting a series of open item bearing containers along a path, b) means for producing and maintaining a modified atmosphere chamber, c) a series of revolving, retractable vanes, said vanes positioned in front of and behind each container in turn, for introducing the containers into and removing the containers from the modified atmosphere chamber, d) means for sealing the open container within the modified atmosphere chamber comprising a rotating drum heat sealing means, and e) means for sequentially removing one or more sealed containers at a time, as said sealed container or containers moves along said path, from said modified atmosphere chamber.

2. An apparatus as claimed in claim 1 wherein, the container introducing means also has a vacuum applying means.

3. An apparatus as claimed in claim 1 wherein, said containers are synthetic material containers, and said sealing means utilizes a thermoplastic film for sealing said containers.

4. An apparatus as claimed in claim 1 wherein, the modified atmosphere is an inert gas.

5. An apparatus as claimed in claim 4 wherein, said inert gas is nitrogen.

6. A method of continuously preparing a plurality of modified atmosphere filled or flushed sealed item bearing containers, the improvement comprising:

a) introducing each container into a modified atmosphere through an entrance means, b) sealing said container utilizing a thermoplastic film and a rotating heated drum sealing means, and c) removing said container from said modified atmosphere through an exit means, and wherein is provided a means for introducing the containers into and removing the containers from the modified atmosphere chamber comprising a series of revolving, retractable vanes, said vanes positioned in front of and behind each container in turn.

7. A method as claimed in claim 6 wherein, said entrance means also includes a means for applying a vacuum during the period the container is isolated from both the ambient atmosphere and the modified atmosphere.

* * * * *